United States Patent [19]

Rosiek et al.

[11] Patent Number: 4,573,446

[45] Date of Patent: Mar. 4, 1986

[54] GAS FIRES

[75] Inventors: Jozef Rosiek, Rainhill; Frank Spruce, Warrington; Brian Atkinson, Wigan, all of England

[73] Assignee: Valor Newhome Limited, London, England

[21] Appl. No.: 568,633

[22] Filed: Jan. 6, 1984

[30] Foreign Application Priority Data

Jan. 8, 1983 [GB] United Kingdom ..... 8300463

[51] Int. Cl.[4] ..... F24C 3/04

[52] U.S. Cl. ..... 126/92 R; 126/127; 126/286; 126/288; 431/125

[58] Field of Search ..... 126/83, 86, 92 R, 92 AC, 126/92 C, 127, 285 R, 286, 288; 236/1 G; 431/125

[56] References Cited

U.S. PATENT DOCUMENTS

| | | | |
|---|---|---|---|
| 464,457 | 12/1891 | Goetz et al. | 126/92 R |
| 3,623,470 | 11/1971 | Wilhoite | 126/127 X |
| 3,831,582 | 8/1974 | Mahoney | 126/286 |
| 4,117,827 | 10/1978 | Billmeyer | 126/288 X |

FOREIGN PATENT DOCUMENTS

| | | | |
|---|---|---|---|
| 1506168 | 4/1978 | United Kingdom | 126/92 |
| 1536339 | 12/1978 | United Kingdom | 126/92 C |
| 2072832 | 10/1981 | United Kingdom | 126/92 AC |
| 1603495 | 11/1981 | United Kingdom | 126/92 R |
| 2096307 | 10/1982 | United Kingdom | 126/92 C |

*Primary Examiner*—Margaret A. Focarino
*Attorney, Agent, or Firm*—Gipple & Hale

[57] ABSTRACT

The present invention discloses an open gas fire having a gas burner, the combustion products of which are fed to a flue system via a heat exchanger for use in providing heated convection air. In the invention an adjustable baffle is arranged to vary the flow-through cross-section of the path of the combustion products to the flue system, thus matching the flue cross-section to the combustion products quantity, thereby reducing the quantity of cold air drawn into the front of the fire and improving thermal efficiency of the gas fire apparatus.

13 Claims, 4 Drawing Figures

GAS FIRES

DESCRIPTION

DESCRIPTION OF THE PRIOR ART

The present invention relates to open front, open flued, gas fires.

More particularly, the present invention relates to open front, open flued, solid fuel effect gas fires, e.g. simulated wood, coal, coke, peat or any combination thereof. Such fires seek to create the appearance of the traditional open front solid fuel fire which still retain considerable appeal. As gas fires do not require manual refueling or clearing of ashes and are very controllable, the appeal of fires simulating the appearance of the traditional open fire is greatly increased.

Solid fuel effect gas fires are already known. These consist essentially of a simulated fuel bed which is heated by-flames or by products of combustion from flames, or may be supported by some means which itself is heated to incandesence. The products of combustion, together with excess air can further be passed through a heat exchanger which is caused to promote warm convected air, thereby increasing the overall thermal efficiency of the fire. However, a principal feature in the appeal of the traditional solid fuel fire is the existence of luminous flames above the main fuel bed. Such flames can be very closely simulated by burning neat gas (i.e. gas with little or no primary aeration) and solid fuel effect gas fires are known which incorporate this feature in addition to the incandescent bed. Such neat gas flames, like those produced by solid fuels, are not static but move or waver about considerably, depending upon the precise movement of air and possibly other products of combustion, around them. It is essential that products of combustion are not allowed to spill into the room to be heated in any appreciable amount and a current British Standard (B.S. 5258 Part 5) specifies tests on gas fires to ensure that they may be deemed to comply with this requirement. The continuous movement or wavering of such luminous flames renders it difficult to ensure that excess spillage of products from the fire does not occur, (particularly in the case of open front fires). Consequently, some solid fuel effect gas fires incorporate a glass front through which the solid fuel effect can be seen and this eliminates the spillage of products of combustion from the front of the fire. The incorporation of such a glass front necessitates the incorporation of a draft diverter, usually located in the flue spigot at the rear of the fire and also necessitates incorporation of a flame failure device. Furthermore, the glass front has certain disadvantages. Firstly, it tends to reduce the similarity to the traditional open solid fuel fire; secondly, the intervention of glass reduces the radiant heat emitted to the room; and thirdly, the necessary incorporation of a draft diverter tends to increase the overall depth of the fire - front to back.

In the case of an open front fire, the problem of products of combustion spillage may be overcome by having a flue gas spigot and all allied routes (e.g. through the heat exchanger), of sufficient cross sectional area to ensure the virtually unrestricted passage of the large volume of air required to enter the front of the fire to effect adequate clearance of products of combustion into the flue. However, the intake of such large volumes of fresh room air through the front opening of the fire would seriously reduce the efficiency of the heat exchanger and the overall thermal efficiency of the fire.

SUMMARY OF THE INVENTION

The aim of the present invention is to provide an open front gas fire of relatively high thermal efficiency, in which the problem of spillage of combustion products has been advantageously resolved.

With such gas fire constructions too much cold air can be drawn into the fire through the front of the fire due to the capacity of the flue system. The flue system has to be able to cope with the maximum quantity of combustion products which can be produced, to thus avoid spillage of the products from the fire. At gas settings other than the setting to produce the maximum combustion product, cold air is then drawn into the flue reducing the thermal efficiency of the fire.

The present invention improves the thermal efficiency of the gas fire.

According to the present invention there is provided an open front, open flued, gas fire comprising a gas burner, the combustion products of which are fed via a heat exchanger to a flue system, an adjustable baffle being arranged to vary the flowthrough cross-section of the path of the combustion products to the flue system.

Preferably the adjustable baffle, or damper, is linked to the gas control tap for the gas burner. This linkage is preferably mechanical. Thus, adjustment of the gas control tap adjusts the damper position and varies the flow-through cross section of the path of the combustion products to the flue. This arrangement enables the optimum flow through the fire to be provided for a selected gas input rate, so that spillage of the combustion products does not occur from the front of the fire and an optimum amount of cold air is drawn into the fire - thermal efficiency of the fire being enhanced. In a preferred embodiment of the present invention, the damper baffle is located in a flue outlet of the flue system, at the exit of the heat exchanger, the outlet being cylindrical and the baffle taking the form of a butterfly valve which, when in a minimum flue flow position, does not completely close the flue outlet. Hereinafter this position is referred to as the closed position.

According to a further feature of the present invention there is provided an open front, open flued, solid fuel effect gas fire comprising a main gas burner and a subsidiary gas burner, the combustion products of said burners being fed via a heat exchanger to a flue system, an adjustable baffle being arranged to vary the flowthrough cross section of the path of the combustion products of at least one burner to the flue system.

In a preferred embodiment of this further feature of the present invention, the main gas burner extends in width largely across the width of a simulated fuel bed of the fire, and is of the primary aerated type of conventional design comprising a steel box enclosed at its top by a stainless steel strap incorporating a number of flame ports. The main burner flame ports face towards the back of the fire and the main burner is inclined upwards at a slight angle so that the products of combustion from the main burner pass essentially underneath the simulated fuel bed which is itself supported at an angle similar to that of the main burner. The subsidiary burner comprises a number of jets capable of burning neat gas (no primary aeration or very low primary aeration) and will be referred to hereinafter as the neat gas burner. This neat gas burner is located above and in front of the main burner, the neat gas flames passing between and above the simulated fuel to provide for realism. At the rear of the fuel bed a splitter plate is situated in front of and distanced from one face of the heat exchanger. This splitter plate terminates below apertures which allow entry to the heat exchanger. Products of combustion from the main burner having progressed largely below the simulated fuel bed and causing the insulating pad to become incandescent, now pass upwards between the splitter plate and the face of the heat exchanger, thus imparting heat to the heat exchanger and at the same time shielding this face of the heat exchanger from any incoming comparatively cold air entering the open front of the fire. The main burner products then enter the two entry apertures in the heat exchanger, pass through the heat exchanger and through the flue outlet into the flue system. Any slight spillage of products of combustion from under the simulated fuel bed will be cleared through the heat exchanger apertures. The two entry apertures to the heat exchanger each incorporate a baffle comprising a horizontal plate projecting forward of the heat exchanger and partially inside, and a curved plate which extends downwards from the horizontal plate and towards the adjacent side of the fire. These baffles damp out vortices formed in the products of combustion and air flow. Such vortices can impart considerable motion to the flow and result in spillage of products of combustion from the front of the fire.

In the preferred embodiment of this further feature of the present invention a flue outlet allows exit for the combustion products from the heat exchanger into the flue system. The flue outlet is cylindrical and houses a damper baffle in the form of a butterfly valve. The butterfly valve is connected by a mechanical linkage to a gas control tap which controls both the main and the neat gas burners. This tap may also be linked to an ignition device, for example a Piezo spark system.

With the gas control tap at maximum input, gas is fed to the main burner only and the flue damper is in the position giving a minimum effective flue area, i.e. the butterfly valve is closed. When the tap is turned to an intermediate position, the gas rate to the main burner is reduced and the neat gas burner is fed with gas while the flue damper assumes the position giving the maximum effective flue area. Obviously it is possible to incorporate variations of this operation, provided that the damper baffle gives the maximum effective flue area when the neat gas burner is in use, giving the luminous flow effect.

Thus, with the control tap at maximum input and the damper baffle basically in the closed position, high thermal efficiency is achieved, a minimum of cold air being drawn into the fire. With the control tap at the intermediate position, the neat gas burner is lit and the copious combustion products are catered for by the damper baffle being in the fully open position. Thus, spillage of combustion products from the front of the fire is avoided and while realism with the luminous flames is enhanced, thermal efficiency is reduced due to the reduction in gas supply to the main burner, and due to the dilution of upward travelling neat flame combustion products by relatively cold air from the front of the fire. At other positions of the gas control tap the damper baffle is adjusted to provide an optimum flow through cross section for the combustion products while keeping the quantity of cold air drawn into the front of the fire to a minimum. Maximum possible heat is thus transferred in the heat exchanger for whatever mix of combustion products is required from the main and neat gas burner.

In a modified embodiment of the present invention the splitter plate is extended upwards so as to cover the apertures which allow entry to the heat exchanger. Thus these inlet apertures are no longer in direct communication with the front of the fire. The major proportion of the combustion products are therefore entrained behind the splitter plate into the heat exchanger. However, the combustion products in the front of the fire, e.g. from the neat gas burner, bypass the heat exchanger by the provision of an additional duct which passes from the front of the fire through the heat exchanger but not in communication with it, to the flue system. The damper baffle is located in this additional duct and is mechanically linked to the fire control tap in a manner similar to that already described. This damper baffle closes the additional duct completely when the main burner is operated at maximum rate, thereby minimizing any cooling effect due to intake of cold air from the front of the fire when the neat gas burner is inoperative, and ensuring that the thermal efficiency of the fire is substantially or completely unaffected at this gas input rate. The damper opens this additional duct when the main burner is reduced in rate by the control tap, and the luminous flame effect is introduced, i.e. the neat gas burner is lit. The additional duct affords a very low resistance direct path for the passage of products of combustion from the luminous flames and therefore the gas rate input to the neat flame burner can be substantially increased without the spillage of products from the front of the fire being affected adversely. However, there will be some loss of thermal efficiency because luminous flame products do not pass through the heat exchanger. When the main burner is at the maximum gas rate, products of combustion from it travel behind the splitter plate, into and through the heat exchangers, hence to the flue. The passage of products of combustion from the main burner flows this same route at lower input rates obtained by operation of the control tap. Obviously, several combinations of operation are possible, provided that the luminous flame effect is introduced at a rate compatible with the position of the damper in the additional duct.

Fires according to the present invention in any variation depending on the same principle, can be made to operate on all fuel gases by provision of suitable injectors and burners. For liquified petroleum gases and possibly some manufactured gases, the neat flame jets are made to incorporate an increase in primary aeration. This will eliminate the possibility of soot formation from the luminous flames.

According to a further aspect of the present invention there is provided an open gas fire comprising a heat exchanger connected with a flue system and having entry apertures for receiving combustion products from the front of the fire, said apertures being arranged one on each side region of the fire and incorporating a baffle arrangement for reducing the possibility of spillage of combustion products from the front of the fire due to the effect of vortices.

Preferably each baffle arrangement comprises a horizontal plate projecting forwards from the heat exchanger and partially inside the associated aperture. Additionally, a curved plate is preferably provided, the curved plate extending downwards from the horizontal plate and towards the adjacent side of the fire. These baffle arrangements damp out vortices formed in the products of combustion and air flow in the area of flue entry into the heat exchanger. Thus the possibility of spillage due to the violent motion imparted to the combustion products by the vortices, is reduced.

The present invention will now be further described, by way of example, with reference to the accompanying drawings, in which:

DETAILED DESCRIPTION OF THE DRAWINGS

Figure 1:
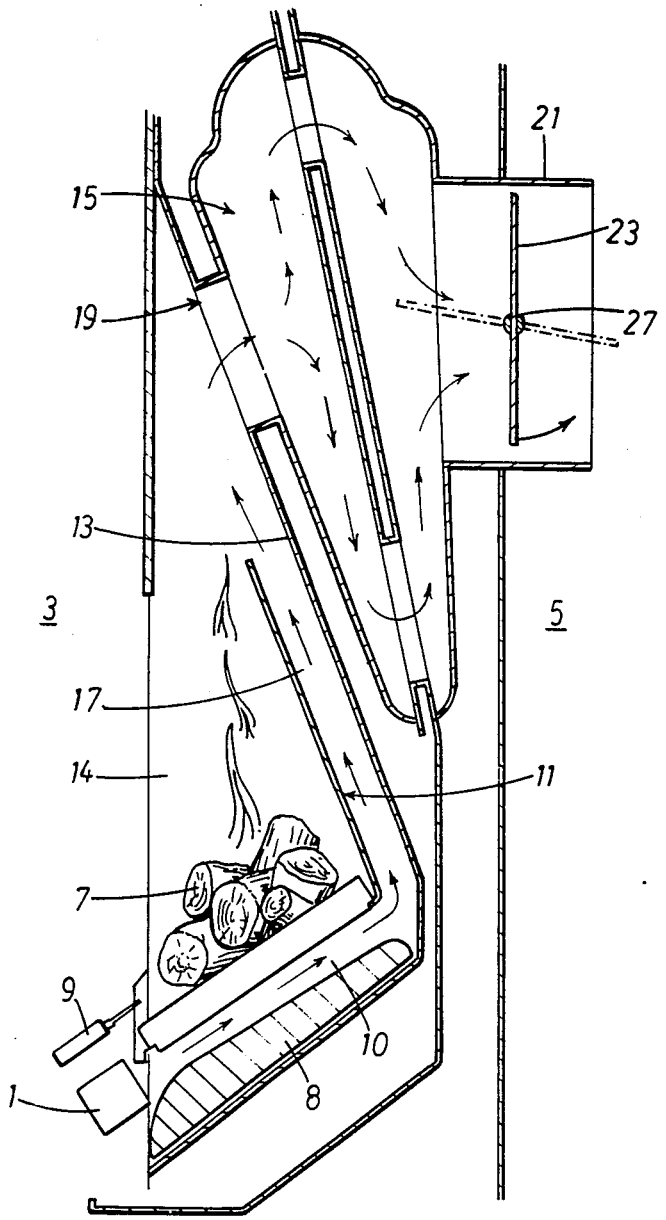
FIG. 1 is a generally schematic cross-sectional view of one embodiment of the present invention.

The gas fire apparatus illustrated in FIG. 1 of the accompanying drawings shows the preferred embodiment and best mode of the present invention and comprises a main burner 1 which extends across the width of the front 3 of the fire. This main burner 1 is of the primary aerated type of conventional design comprising a steel box enclosed at its top by a stainless steel strip incorporating a number of flame ports. The main burner ports face towards the back 5 of the fire and the burner 1 is inclined upwards at a slight angle so that the products of combustion from the main burner 1 pass essentially underneath a simulated fuel bed 7 which is itself supported at an angle similar to that of the main burner 1. An insulating pad 8 located below the simulated fuel bed 7 defines, with the fuel bed 7, a passage 10 along which the combustion products from the main burner 1 can pass thereby providing the desired incandescent effect. A subsidiary burner in the form of a neat gas burner 9 is situated above and in front of the main burner 1, the neat gas flames (when operative) passing between and above the simulated fuel on the simulated fuel bed 7. At the rear of the fuel bed 7, a splitter plate 11 is situated in front of and spaced from a back panel 13 of the fire hose 14, to thus define an upwardly extending passage 17 for combustion products from main burner 1. A heat exchanger 15 is located behind the back panel 13.

In the upper part of the fire the heat exchanger 15 has two entry apertures 19 (only one of which is evident in the drawings) which provide access to the heat exchanger 15. As the splitter plate 11 terminates below the entry apertures 19 which are arranged one on each side region of the fire, the combustion products from the neat gas burner 9 and from the main burner 1 via passage 17, pass through apertures 19 into the heat exchanger 15. As illustrated by the arrows in FIG. 1, the combustion products follow a tortuous path through the heat exchanger 15 to allow for the maximum possible heat transfer to convected air flowing through a completely separate path (not illustrated) in the heat exchanger. The combustion products flow out from the heat exchanger 15 into a flue system via a flue outlet member 21 in which a damper baffle 23 in the form of a butterfly valve, is located. When in the closed position, as illustrated in FIG. 1, the baffle 23 does not completely seal off the outlet member 21.

Figure 2:
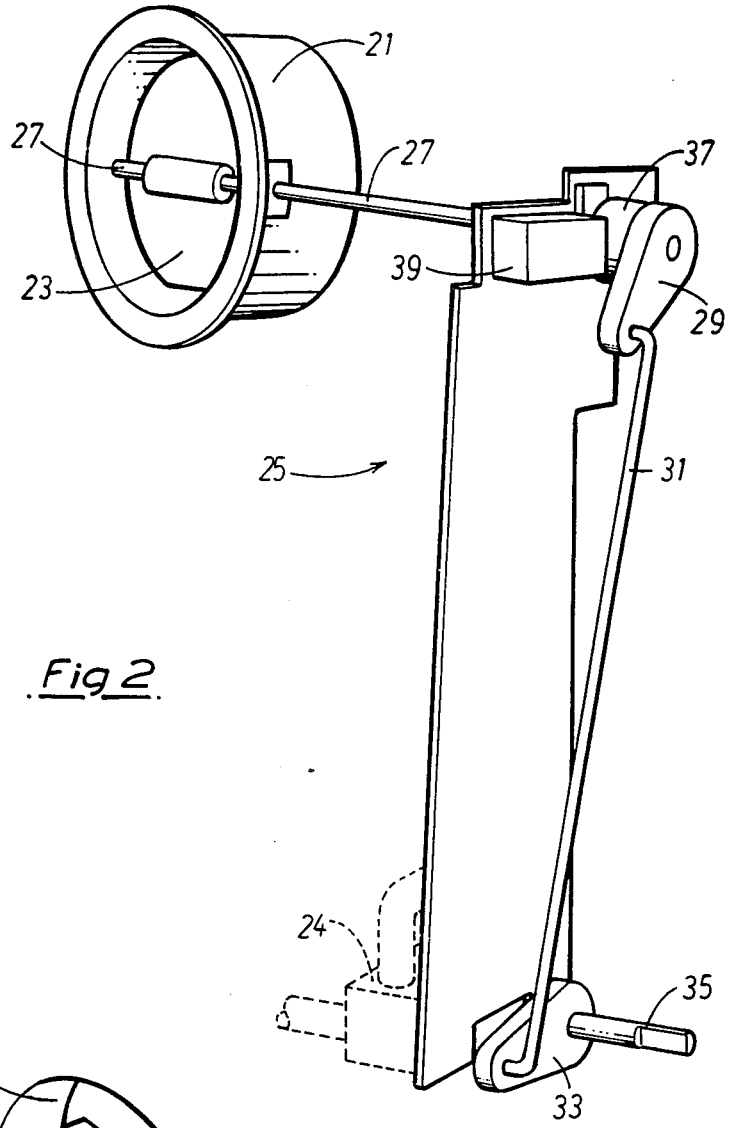
FIG. 2 shows a preferred form of the linkage between baffle and gas control tap.

As best shown in FIG. 2, the baffle 23 is coupled to a gas control tap 24 via a mechanical linkage generally designated 25. The baffle 23 is mounted on a rotatable axle 27 which extends from the outlet member 21 and connects via a lateral lever arm 29, with one end of a connecting rod 31. The other end of the connecting rod 31 is also connected to a lever arm 33 which extends laterally from a rotatable control spindle 35 of the gas control tap 24. Thus by operation of the spindle 35, i.e. of the control gas tap, the rotatable position of baffle 23 can be adjusted.

The linkage 25 is so designed, preferably by keyways on the various component parts, that with the gas control tap set to allow for a maximum gas input rate to the main burner 1, the neat gas burner 9 being switched off, the baffle 23 is in its illustrated fully closed position. In this situation maximum thermal efficiency and heat output from the fire is obtained, the flue and baffle only allowing a minimum of cold air to be drawn into the fire. With the gas control tap in an intermediate position the gas supply to the main burner 1 is reduced and gas is supplied to the neat gas burner 9.

Figure 4:
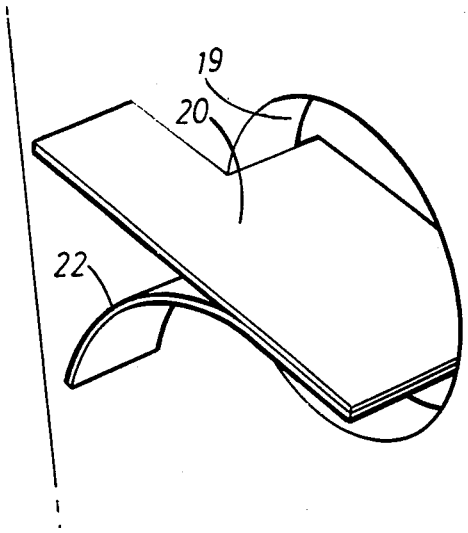
FIG. 4 is a perspective view of an entry aperture leading to the heat exchanger of FIG. 1, and incorporating a baffle arrangement.

The combustion products are therefore increased to a maximum and the baffle has thus been moved to the fully open position. The flow-through cross-section provided is sufficient to prevent spillage of combustion products out from the front of the fire having regard to the quantity and rate of flow of such combustion products. However, vortices produced in the flue products around the flue entry apertures 19 tend to disrupt the smooth flow of the products into the heat exchanger 15. To damp out these vortices and reduce the possibility of spillage from the front of the fire, a baffle arrangement 20,22 (see FIG. 4) is provided in each entry aperture 19 to heat exchanger 15. Each baffle arrangement 20,22 comprises a horizontal plate 20 which extends through the aperture 19 into the heat exchanger 15, and projects forwardly and to the side relative to the fire. This horizontal baffle plate 20 prevents the combustion products from spiralling down the side regions of the fire, away from apertures 19, due to the vortices produced in this fast flow. To smooth out the upward flow of combustion products in the side regions of the fire, curved baffle plates 22 are preferably located immediately underneath the horizontal baffle plates 20, the plates 22 curving downwards towards the sides of the fire.

As can be seen in FIG. 2 a cam 37 is provided on an axle 27, this cam operating a valve 39 which controls the gas flow to the burner 9. Thus, the valve 39 will only allow gas to flow to the neat gas burner 9 when the baffle 23 is in the requisite open position. Any other valve arrangement can of course be substituted.

Figure 3:
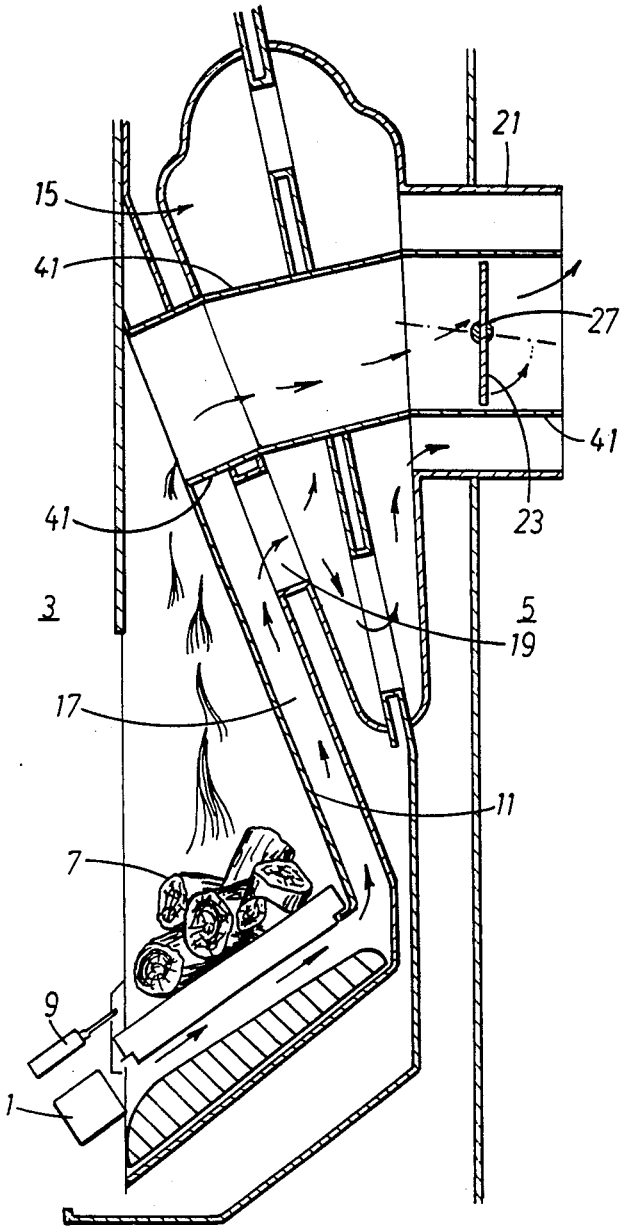
FIG. 3 is a generally schematic cross-sectional view of another embodiment of the present invention.

Another embodiment of the present invention is illustrated in FIG. 3. Like reference numerals have been inserted in FIG. 3, as in FIGS. 1 and 2 for equivalent parts. The main difference from the embodiment of FIG. 1 lies in the fact that splitter plate 11 is extended up to the top of the fire, closing entry apertures 19 to the combustion products from the neat gas burner 9, and an additional duct 41 has been provided, which extends from the front of the fire, through the heat exchanger 15 without communicating therewith, to the back of the fire. This additional duct 41 extends through the flue outlet concentrically therewith to allow access to the flue system (not shown). The baffle 23, again in the form of a butterfly valve is mounted within the additional duct 41, and, when closed, completely seals the additional duct 41. The baffle 23 is controlled by a linkage 25 as per FIG. 2, as described with reference to the embodiment of FIG. 1. Thus, in operation with the gas control tap at a position allowing for maximum gas input, the main burner 1 above is provided with gas and the combustion products pass behind the splitter plate 11, through the heat exchanger 15, and out via outlet member 21 around duct 41. Duct 41 is closed by baffle 23 so that only a negligible quantity of cold air is drawn into the fire and the fire therefore gives maximum heat output. To enhance realism the gas control tap is moved to an intermediate position wherein gas to the main burner 1 is reduced and gas is supplied to the neat gas burner 9. The baffle 23 is then moved via linkage 25 to the requisite position to allow the combustion products from the neat gas burner 9 to escape to the flue system. However, no thermal advantage is obtained from these combustion products as they pass through duct 41 and bypass the heat exchanger 15.

The present invention thus provides an open gas fire which can be operated to give high thermal efficiency with little realism, or with reduced thermal efficiency and realism produced by the wispy, luminous flames of the neat gas burner, the baffle being adjusted to provide the optimum through-flow cross section for combustion products to the flue system with a minimum of cold cooling air being drawn into the front of the open fire at all gas input rates.

We claim:

1. An open front, open flued, solid fuel effect gas fire assembly comprising a main gas burner and a subsidiary gas burner adapted to produce combustion products, means for directing the combustion products of said burners to a heat exchanger, said heat exchanger being configured to feed said combustion products to a flue means, an adjustable baffle being linked by a mechanical linkage, to a gas control tap which controls both the main and subsidiary burners, so that adjustment of the gas control tap can vary the flow through cross-section of the path of the combustion products of at least one burner to the flue means.

2. A gas fire assembly according to claim 1, further comprising a simulated fuel bed and wherein the main gas burner extends across the major portion of the width of the simulated fuel bed, said main gas burner defining flame ports facing rearward and being inclined to the horizontal so that combustion products from the main burner pass essentially underneath the simulated fuel bed which is itself similarly inclined.

3. A gas fire assembly according to claim 2, wherein the main gas burner is of the primary aerated type and the subsidiary burner is capable of burning neat gas.

4. A gas fire assembly according to claim 3, wherein the subsidiary burner is located in front of and above the main burner with respect to position of the fire.

5. A gas fire assembly according to claim 3, further comprising a splitter plate situated at the rear of the simulated fuel bed, in front of and spaced from one face of the heat exchanger, to thus define a passageway therebetween for the combustion products passing beneath the simulated fuel bed.

6. A gas fire assembly according to claim 5, wherein an aperture entrance to the heat exchanger is located above the splitter plate.

7. A gas fire assembly according to claim 1, wherein said heat exchanger defines two apertures, each including a baffle means comprising a horizontal plate projecting forwards from the heat exchanger and partially inside, and a curved plate extending downwards from the horizontal plate and towards the adjacent side of the fire assembly.

8. A gas fire assembly according to claim 1, wherein a flue outlet member acts as the exit from the heat exchanger for the combustion products, and houses the adjustable baffle.

9. A gas fire assembly according to claim 8, wherein the flue outlet member is cylindrical and the adjustable baffle is in the form of a butterfly valve.

10. A gas fire assembly according to claim 1, wherein the adjustable baffle is moved to a position in which it allows for a minimum effective flue area when the gas control tap is at maximum output, gas being fed to the main burner only, and the adjustable baffle is moved to a position allowing for the maximum effective flue area when the gas control tap attains an intermediate position in which the gas supply to the main burner is reduced, and the subsidiary burner is fed with gas.

11. A gas fire assembly according to claim 5, wherein the splitter plate extends upwardly over an aperture entrance to the heat exchanger, an additional duct passing from the front of the fire through the splitter plate and connecting with the flue system while bypassing the heat exchanger, the adjustable baffle being housed in the additional duct.

12. A gas fire assembly according to claim 11, wherein the adjustable baffle is linked to a gas control tap common to both burners, and can be moved to a position wherein the additional duct is completely closed.

13. An open gas fire apparatus comprising a heat exchanger connected with a flue means, said heat exchanger defining at least one entry aperture for receiving combustion products from the front of a fire area, said at least one aperture incorporating a baffle arrangement for reducing the possibility of spillage of combustion products from the front of the fire area due to the effect of vortices, wherein such baffle arrangement comprises a generally horizontal plate projecting towards the front of the fire area and also partially inside the associated aperture, and a curved plate extending downwards from the generally horizontal plate and towards the adjacent side of the fire area.

* * * * *